United States Patent [19]

Forbes, Jr.

[11] 4,312,451

[45] Jan. 26, 1982

[54] SELF STANDING FLANGED TRAY WITH INTEGRAL LID

[75] Inventor: Hampton E. Forbes, Jr., Wilmington, Del.

[73] Assignee: Westvaco Corporation, New York, N.Y.

[21] Appl. No.: 59,397

[22] Filed: Jul. 20, 1979

[51] Int. Cl.[3] ..... B65D 5/66; B65D 5/24

[52] U.S. Cl. ..... 206/628; 229/44 R; 206/504

[58] Field of Search ..... 206/806, 518, 626, 634, 206/461, 45.14, 628, 504, 507; 229/43, 44 R

[56] References Cited

U.S. PATENT DOCUMENTS

| | | | |
|---|---|---|---|
| 3,113,680 | 12/1963 | Frater et al. | 206/507 |
| 3,410,697 | 11/1968 | Stephenson | 229/43 |
| 3,863,832 | 2/1975 | Gordon . | |
| 3,865,302 | 2/1975 | Kane . | |
| 3,917,155 | 11/1975 | Bemiss . | |
| 4,019,675 | 4/1977 | Andersson | 229/43 |
| 4,183,458 | 1/1980 | Meyers | 206/626 |
| 4,202,464 | 3/1980 | Mohs | 206/634 |
| 4,209,095 | 6/1980 | Dutcher | 206/626 |

*Primary Examiner*—Herbert F. Ross

[57] ABSTRACT

A container for packaging, storing, displaying and heating food is prepared from a blank of paperboard that is coated on at least one side with a thermally stable material. The container consists of a plurality of upstanding walls foldably connected to a bottom panel; corner closures foldably connected between said upstanding walls; a peripheral flange located around all except one of said upstanding walls; and, an integral lid foldably connected to the remaining upstanding wall wherein all except the remaining upstanding wall diverge with respect to the bottom panel which permits the container to be nested with others when empty, and self standing along the remaining straight upstanding wall after being filled and closed.

2 Claims, 4 Drawing Figures

SELF STANDING FLANGED TRAY WITH INTEGRAL LID

BACKGROUND OF THE INVENTION

The present invention relates generally to the art of food packaging and more particularly to a container for packaging, storing, displaying and heating food.

Containers of the type disclosed herein are well known in the art. They are low in cost, disposable and are adapted to protect the food packaged therein under various temperature conditions. Moreover, such containers are capable of being formed on high speed equipment. However, the prior art does not disclose a container which incorporates all of the features of the present invention.

For example, considering exemplary prior art patents, U.S. Pat. No. 3,917,155 discloses a laminated package in the form of a flanged, open top tray with an integral lid. Containers formed in accordance with the teachings of this patent are acceptable for most purposes, but once these containers are formed, they are difficult to store because their side walls are straight and are all of the same dimensions. Thus, users of the container disclosed in U.S. Pat. No. 3,917,155 must also have forming equipment so the containers can be formed and filled in line without intermediate storage. Meanwhile, U.S. Pat. No. 4,019,675 which also shows a flanged, open top tray with an integral lid, overcomes the storage problems of the aforementioned patented construction by making the side walls divergent to achieve a nest. However, after being filled, the containers formed in accordance with the teachings of U.S. Pat. No. 4,019,675 must be displayed horizontally, or, on top of one another because the tapered side walls will not allow the containers to stand along one edge. Thus, while the users of the container disclosed in the latter patent need only have edge sealing equipment, the resulting construction is not versatile from a product storage and display point of view. Finally, other exemplary prior art, including U.S. Pat. Nos. 3,863,832 and 3,865,302, each show two part containers prepared from separate lids and trays, and the container constructions represented by these patents present yet other problems. For instance, when two part containers are selected, the user must keep separate inventories of lids and trays. In addition, special equipment is required for sealing the containers, particularly for correctly aligning the lids with the trays. Moreover, where the trays have divergent side walls, which is generally the case, the options available for storing and displaying the filled containers are limited.

Another problem typical of many of the prior art constructions is the difficulty of removing the lid from the tray when it is desired to serve the food packaged therein. This problem varies with the type of material used to construct the container. Typically, the most severe problems occur with thermoplastic coated paperboard containers when the lid is heat sealed to the tray. With such constructions, the heat seal can be strong enough to require the use of a knife in order to get the lid removed in one piece. Thus, while the prior art discloses a number of container constructions which satisfy one or more of the desirable features required by the users of such food packages, the prior art does not disclose a container which satisfies all of the criteria previously outlined.

SUMMARY OF INVENTION

According to the present invention, a container is disclosed for the packaging of food, and more particularly for the convenient display of packaged food products.

The invention comprises a container in the form of an open top flanged tray which has an integral top. The container is preferably constructed from a thermally stable paperboard material that is generally referred to as an ovenable paperboard. For this purpose the paperboard is coated on at least one side with a heat sealable thermoplastic material or a polyester material such as polyethylene terephthalate. Examples of such paperboard are disclosed in U.S. Pat. Nos. 3,865,302 and 4,147,836. In any event, depending upon the type of coating applied to the paperboard, the lid is either heat sealed or adhesively glued to the tray flange after the container is filled.

The tray of the present invention includes a base portion or bottom and a plurality of upstanding side walls. The upstanding side walls are interconnected by corner closures in the form of gusset panels which are overlappingly bonded to an adjacent side wall. Meanwhile, the upstanding side walls each include extensions that are foldably attached to the upper edges thereof which form a peripheral flange around the tray. The flange extensions overlap one another at each corner and are also bonded together to reinforce the peripheral flange. In addition, to aid in opening the container for serving the packaged food, the container blank disclosed herein is applied with microcuts either around the periphery of the lid where it is joined to the tray flange, or along the score lines connecting the flange extensions to the upstanding side walls. The microcuts weaken the paperboard in the area adjacent to where they are applied which permits the paperboard in that area to delaminate easily when the lid is removed. The delamination of the paperboard either to the lid or to the flange area (depending upon where the microcuts are applied), allows the user to open the container without undue effort. And, finally, the upstanding side walls of the tray are particularly oriented with respect to the tray bottom to enable the formed trays to be nested with one another during storage and to be self standing when filled for convenience in display. For this purpose, all except one of the tray side walls diverge with respect to the bottom wall which permits the formed trays to be nested with one another during storage. Meanwhile, the remaining side wall which also has the tray lid integrally attached thereto remains straight and nondivergent to permit the container to be self standing along the straight side wall after the container is filled and closed.

Accordingly, the present invention provides a unique container which is readily filled and sealed because of its one piece construction, and which also demonstrates versatility in storage and display. Moreover, the container of the present invention is provided with a convenient opening scheme whereby the filled containers can be opened without tearing the lid or the use of knives or the like.

Additional details of the invention will be disclosed in the following description, taken in conjunction with the accompanying drawings.

DETAILED DESCRIPTION

Figure 1:
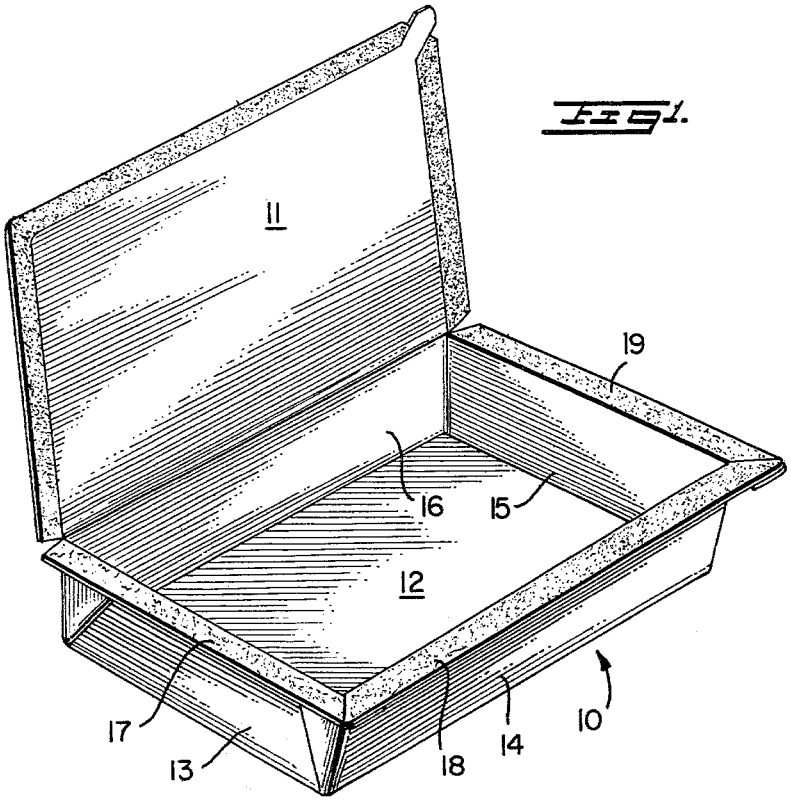
FIG. 1 is a perspective view of a container according to the present invention.

A preferred embodiment of the present invention is illustrated in FIG. 1 wherein there is shown a tray 10 having an integral lid 11. The tray includes a rectangular base 12, however, the shape could be of any different polygonal form having multiple sides. A plurality of upstanding side walls 13,14,15 and 16 are shown foldably connected to the base portion 12 and each of the side walls 13,14 and 15 also have flange extensions 17,18 and 19 foldably attached to the upper edges thereof and disposed in a plane substantially parallel to that of base portion 12. In accordance with the present invention, the side walls 13,14 and 15 are divergently disposed from the base portion 12 while the remaining or rear wall 16 is substantially straight or perpendicular to the base portion 12. The divergently disposed walls 13,14 and 15 permit the trays 10 to be nested after being formed for storage, and the straight rear wall 16 permits the formed, filled and sealed container to be self standing along its straight wall 16 for display.

Figure 2:
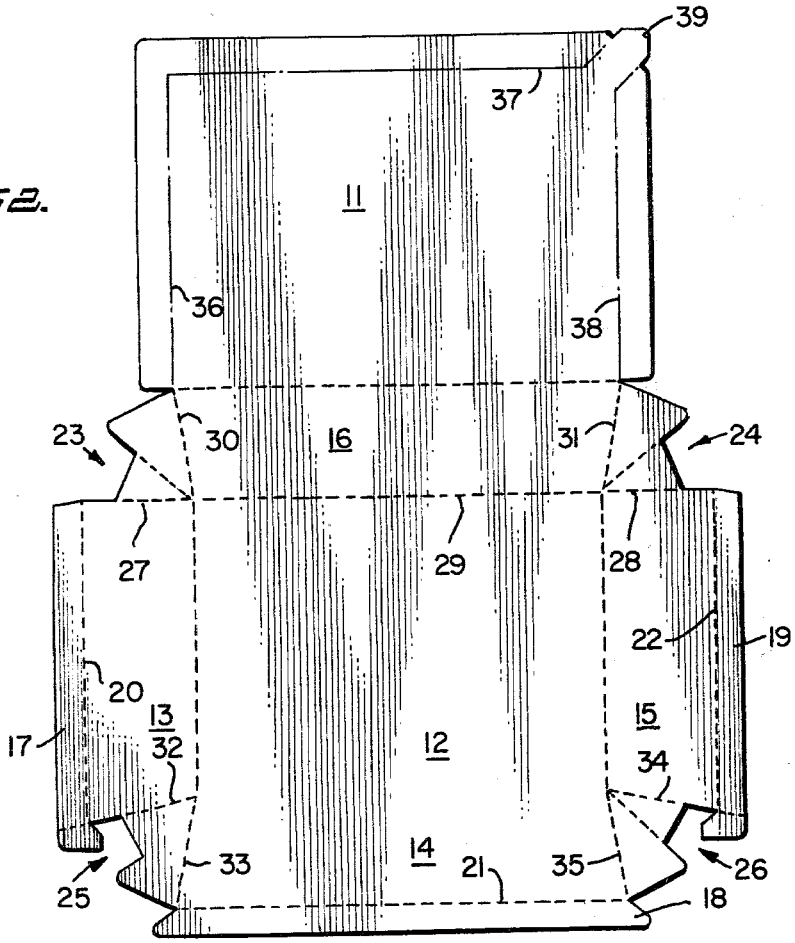
FIG. 2 is a plan view of a blank for constructing the container shown in FIG. 1.

Referring to FIG. 2, it will be seen that the flange extensions 17,18 and 19 are foldably connected to the side walls 13,14,15 along scored lines 20,21,22 respectively. When the blank of FIG. 2 is erected to form a tray 10 as shown in FIG. 1, the flanges 17,18 and 19 become horizontally disposed. Moreover, the ends of the flanges 17,18 and 19 are extended and transversely cut to overlap one another at the ends of wall 14. Meanwhile, the side walls 13,14,15 and 16 are connected to one another by gusset panels 23,24 and 25,26. The gusset panels 23,24 are substantially identical and connect the side walls 13,15 to the rear wall 16. In this regard, note that the score lines 27,28 along the side walls 13,15 are straight extensions of the score line 29 connecting the side wall 16 to the base portion 12. This orientation in conjunction with the angulated score lines 30,31 which connect the gusset panels 23,24 to the rear wall 16 permits the blank to be folded and produce a substantially straight or perpendicular rear wall 16 with divergent side walls 13,15. Meanwhile, at the front end of the tray, the score lines 32,34 and 33,35 are each angulated to provide a divergent front wall 14 attached to the divergent side walls 13,15. Thus, as mentioned hereinbefore, the tray 10 is readily formed from the blank of FIG. 2 to provide a construction that can be nested but one that is still capable of being self standing along its straight side wall 16.

At the upper end of the blank of FIG. 2, the lid portion 11 is provided with microcuts 36,37,38 along its peripheral edges to provide the delaminating opening feature of the container, and an easy opening tab 39 is incorporated into the lid structure to assist in opening the container. The lid 11 is of sufficient size that the portions thereof outside the microcuts 36,37,38 become bonded either with adhesive or with a heat seal to the flange portions 17,18,19 of the tray 10. When the microcuts are applied to the lid as shown, the paperboard in that area delaminates and remains adhered to the flange portions 17,18,19 when the lid 11 is removed. In another embodiment of the present invention (not shown), the microcuts can be applied along or over the scored lines 20,21,22 which separate the flanges 17,18 and 19 from their respective side walls. When so applied, two results are achieved. First, the microcuts make the paperboard more flexible in that region which makes it easier to fold the flanges 17,18 and 19 into their substantially horizontal position, and secondly, when the lid is removed, the paperboard in the region of the flanges delaminates and remains adhered to the lid. In either case, the microcuts make the opening feature more reliable and complete as compared with the prior art.

Figure 3:
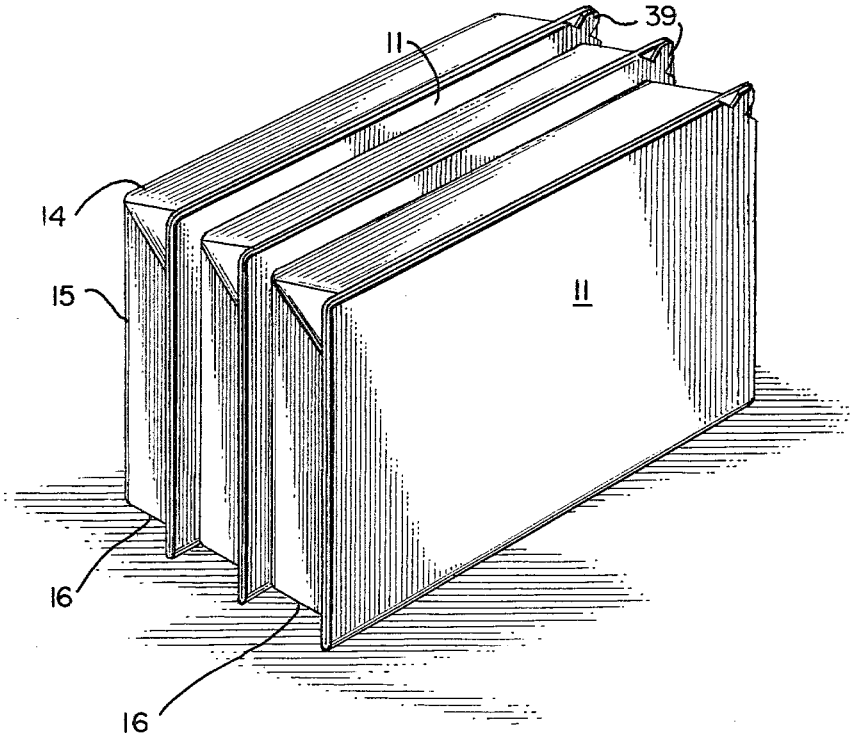
FIG. 3 illustrates the container of the present invention in its self standing display condition; and, FIG. 4 shows an example of an alternate display feature for the container disclosed herein.
Figure 4:
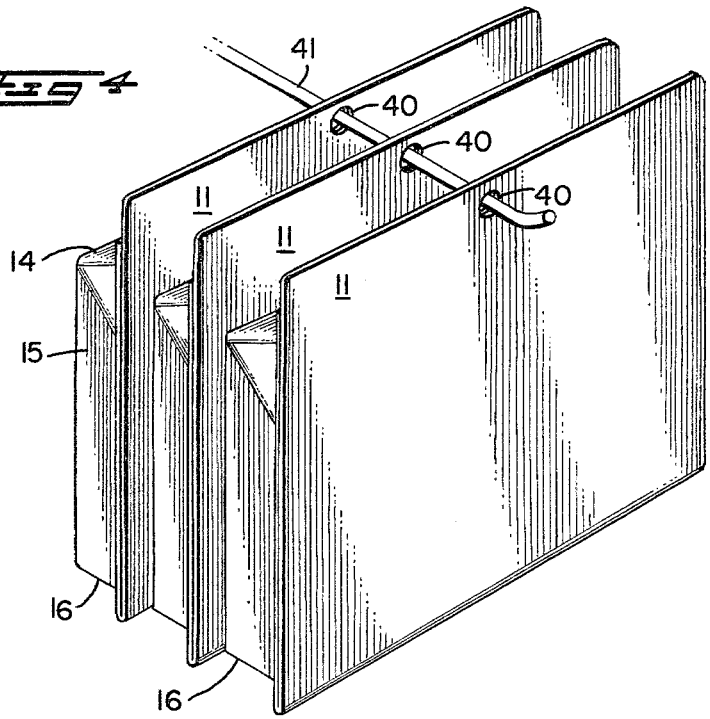

FIG. 3 illustrates the self standing feature of the present invention wherein two containers are shown standing freely on their straight rear walls 16. In this manner, the containers offer the user an alternative to simply storage on top of one another as provided by the prior art. Moreover, by standing the containers on their edges, the tops or lid portions 11 become readily exposed, so that graphics and other identification matter printed thereon is visible to the consumer which is an advantage to the seller of the products packaged therein. Meanwhile, FIG. 4 illustrates an alternative rack type display for the container of the present invention. For this purpose, the lids 11 are made oversize with an extension that is applied with an opening 40 through which a pin element 41 may pass for suspending the containers on a pin type display panel. This option presents yet another advantage for the container of the present invention wherein the graphics on the lid 11 are fully visible to a potential purchaser.

Accordingly, there has been described a new and improved food package, as well as a one piece blank for making the same, that is particularly adapted for the display of goods packaged therein. In addition, the container disclosed is not only useful for packaging and storing the contents, but also it may be used as a means for cooking the packaged food. Thus, while the invention has been described in connection with a preferred embodiment, it will be understood that it is not intended to cover all alternative modifications and equivalents as may be included within the spirit and scope of the invention as defined in the appended claims.

I claim:

1. A container for packaging, storing, displaying and heating food prepared from a single blank of flexible material such as coated paperboard to form an integral tray and lid comprising:

(a) a base portion formed by opposed score lines in the blank material;

(b) a plurality of upstanding tray walls foldably attached to said base portion along said opposed score lines;

(c) a plurality of gusset panel corner closures foldably connected to said upstanding tray walls by paired score lines which emanate from the intersection of said opposed score lines, said gusset panels being overlappingly bonded together and between said upstanding tray walls;

(d) a plurality of extensions foldably attached to all except one of said upstanding tray walls, the ends of which abut each other to form a peripheral flange; and, (e) an integral lid foldably attached to the remaining upstanding tray wall and adapted to overlap and be sealed to said peripheral flange to close said container, said lid including microcuts around the entire periphery thereof except in the region where the lid is joined to the remaining upstanding tray wall to permit the paperboard to delaminate from the lid to the peripheral flange when the container is opened, and a container opening tab located along an edge thereof remote from the connection of the lid to the said remaining upstanding tray wall for opening said container, the improvement wherein the paired score lines which connect the remaining upstanding tray wall to its adjacent tray walls are oriented to that one score line of each pair is a straight extension of the opposed score line between said base portion and said remaining upstanding side wall and the other score line of each pair diverges from the opposed score lines between said base portion and the adjacent tray walls to produce a tray in which all except said remaining upstanding tray wall are divergent with respect to said base portion which permits the tray portions of separate containers to be nested when empty and the sealed containers to be self standing along said remaining substantially straight and nondivergent upstanding tray wall for display after being filled and closed.

2. The container of claim 1 wherein said lid includes an extension along the edge thereof opposite the connection to said remaining upstanding wall, said extension including an opening which permits the container to be racked on a point-of-purchase display.

* * * * *